US005086970A

United States Patent [19]

Su

[11] Patent Number: 5,086,970

[45] Date of Patent: Feb. 11, 1992

[54] ENVELOPE FOR SAFELY PROTECTING DOCUMENTS

[76] Inventor: Ken J. Su, No. 102, Lane 52, Fu-Te Rd., Shu Wang Tsun, Ta-Li Shiang, Taichung Shien, Taiwan

[21] Appl. No.: 647,076

[22] Filed: Jan. 29, 1991

[51] Int. Cl.[5] ..... B65D 27/22

[52] U.S. Cl. ..... 229/84; 383/903

[58] Field of Search ..... 229/72, 84, 1.5 R, 76, 229/77, 82; 383/903, 86, 86.1

[56] References Cited

U.S. PATENT DOCUMENTS

| | | | |
|---|---|---|---|
| 1,558,921 | 10/1925 | Reichle | 229/72 |
| 1,743,305 | 1/1930 | Banks | 229/1.5 R |
| 2,100,768 | 11/1937 | Schuknecht | 229/84 |
| 2,996,239 | 8/1961 | Lennartz | 229/72 |
| 3,372,857 | 3/1968 | Brayla | 383/903 |
| 3,485,437 | 12/1969 | Gruentzel et al. | 383/903 |
| 3,593,913 | 7/1971 | Brener | 229/72 |
| 4,485,962 | 12/1984 | Farley | 229/1.5 R |
| 4,765,485 | 8/1988 | Perkins | 229/84 |

FOREIGN PATENT DOCUMENTS

| | | | |
|---|---|---|---|
| 21555 | 10/1905 | Austria | 229/82 |
| 659310 | 6/1929 | France | 229/1.5 R |
| 818837 | 8/1959 | United Kingdom | 383/903 |
| 969631 | 9/1964 | United Kingdom | 229/77 |
| 1054210 | 1/1967 | United Kingdom | 383/903 |
| 1231686 | 5/1971 | United Kingdom | 383/903 |

*Primary Examiner*—Stephen P. Garbe

*Attorney, Agent, or Firm*—Varndell Legal Group

[57] ABSTRACT

An envelope includes a face and a base having a side edge integrally formed together and having a bottom edge welded together. A slot is formed in an upper edge portion of the face. A flap is integrally formed on an upper edge portion of the base and an ear is formed in the flap. The ear is insertable through the slot of the face when the flap is folded and superposed upon the face so that the upper edge portions of the face and of the base can be clamped together and so that papers disposed within the envelope can be safely and stably retained in place.

1 Claim, 5 Drawing Sheets

ENVELOPE FOR SAFELY PROTECTING DOCUMENTS

BACKGROUND OF THE INVENTION

1. Field of the Invention

The present invention relates to an envelope, and more particularly to an envelope for safely and stably protecting the papers or documents disposed therein.

2. Description of the Prior Art

An envelope which is commercially available is shown in FIG. 5 and includes a face 50 and a base 60 having a side edge 70 integrally formed together and having a bottom edge 80 welded together. The face 50 and the base 60 should be separated or should be opened so that papers can be inserted therebetween. When the envelope is opened, the bottom edge 80 which is welded together is apt to be torn down so that the durability is bad and the working life of the envelope is short. In addition, no clamping or locking devices are provided so that the documents or the papers disposed within the envelope are apt to slip out of the envelope.

The present invention has arisen to mitigate and/or obviate the afore-described disadvantages of the conventional envelopes.

SUMMARY OF THE INVENTION

The primary objective of the present invention is to provide an envelope which has a clamping and locking device for safely and stably retaining the documents or the papers disposed within the envelope.

Another objective of the present invention is to provide an envelope of which the welded edge will not be easily torn down.

In accordance with one aspect of the invention, there is provided an envelope which includes a face and a base having a side edge integrally formed together and having a bottom edge welded together. A slot is formed in an upper edge portion of the face. A flap is integrally formed on an upper edge portion of the base and an ear is formed in the flap. The ear is insertable through the slot of the face when the flap is folded and superposed upon the upper edge portion of the face so that the upper edge portions of the face and of the base can be clamped together and so that the documents and the papers disposed within the envelope can be safely and stably retained in place.

In accordance with another aspect of the invention, a weld of the bottom edge is extended to the other side edge of the envelope and ends with a tear-proof nick in order to prevent the weld from directly torn down when the envelope is opened.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
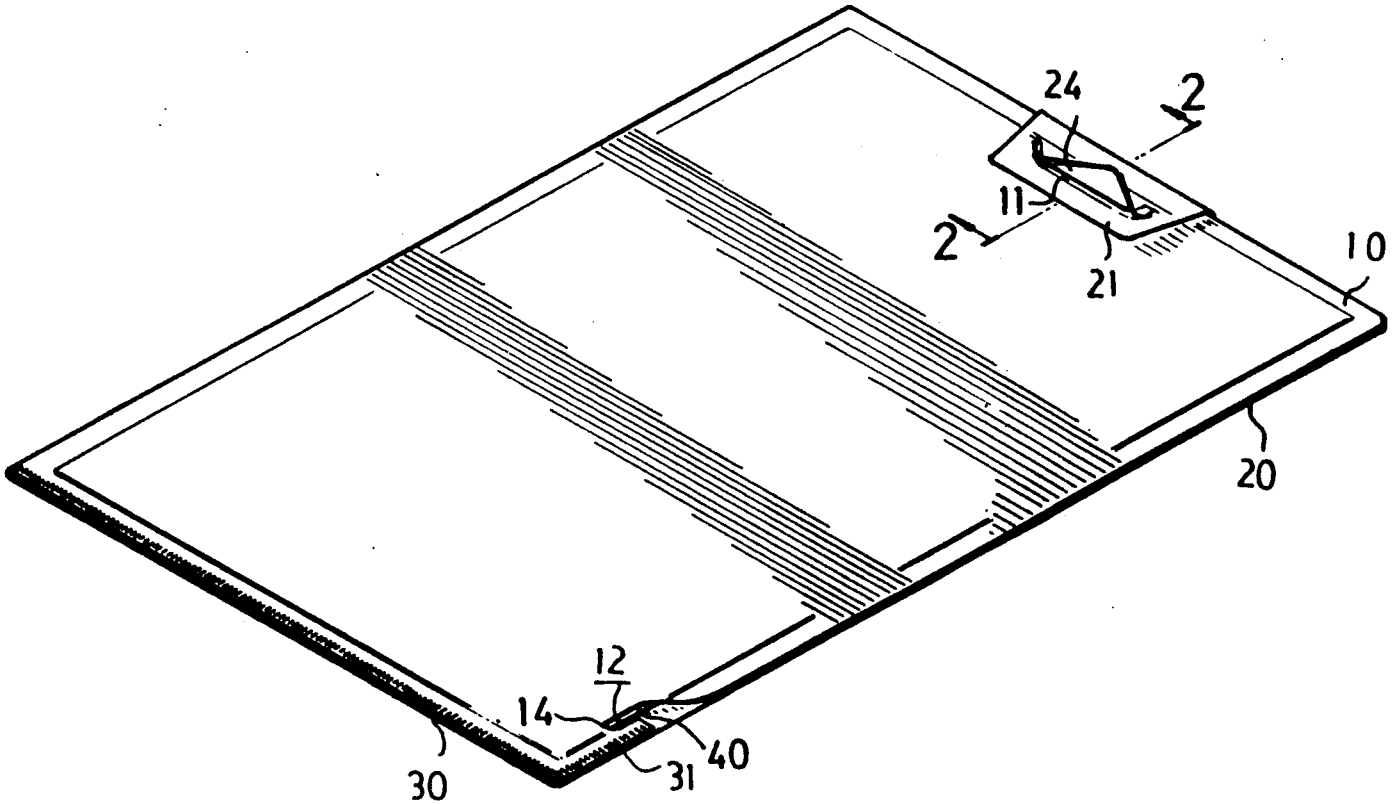
FIG. 1 is a perspective view of an envelope in accordance with the present invention.
Figure 2:
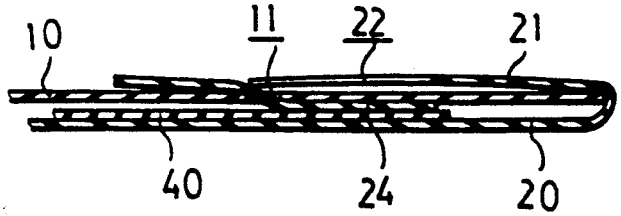
FIG. 2 is a cross sectional view of the envelope taken along lines 2—2 of FIG. 1.
Figure 3:
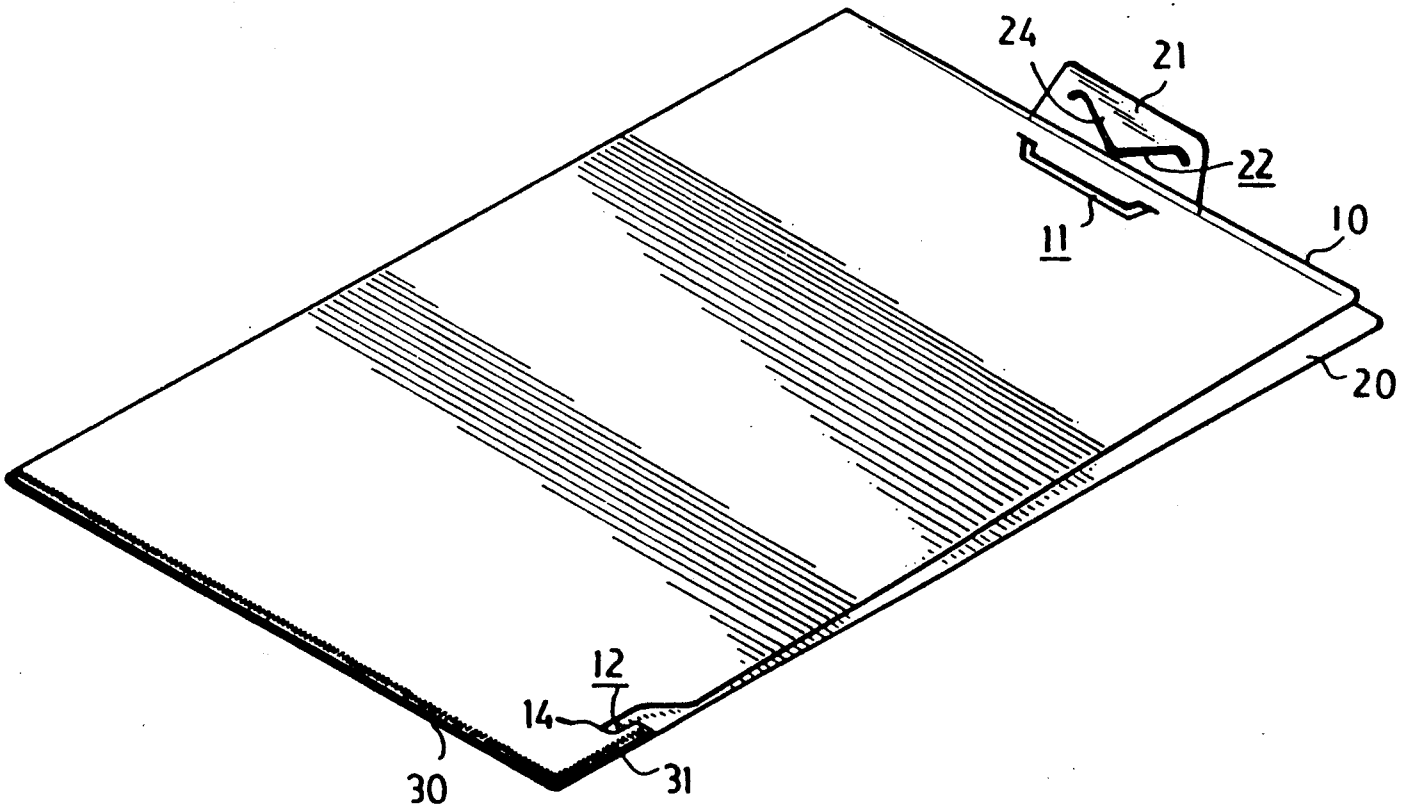
FIG. 3 is a perspective view, in which the clamping and locking device is opened.

Referring to the drawings and initially to FIGS. 1, 2 and 3, an envelope in accordance with the present invention comprises generally a face 10 and a base 20 having a side edge integrally formed together and having a bottom edge 30 welded together by such as ultrasonic heat weld. A slot 11 is formed in an upper edge portion of the face 10. A flap 21 which is integrally formed on the upper edge portion of the base 20 has a V-shaped groove 22 formed therein so that an ear 24 which is triangular is formed. As shown in FIG. 2, the triangular ear 24 is insertable through the slot 11 and can be retained between the face 10 and the base 20 when the flap 21 is folded and superposed upon the face 10 so that the upper edge portions of the face 10 and of the base 20 can be clamped together and so that the paper or the document 40 can be safely and stably retained in place between the face 10 and the base 20.

Figure 4:
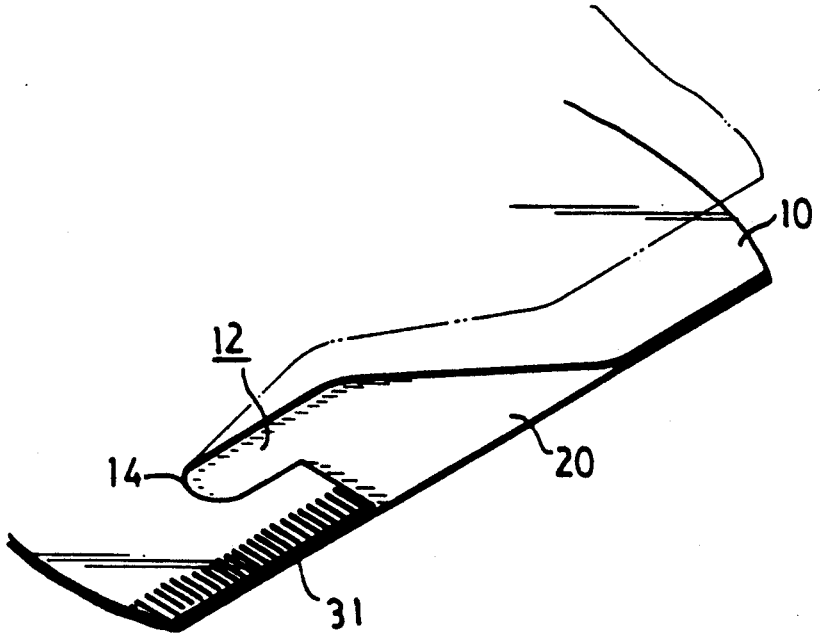
FIG. 4 is an enlarged partial perspective view of the corner area of the envelope.
Figure 5:
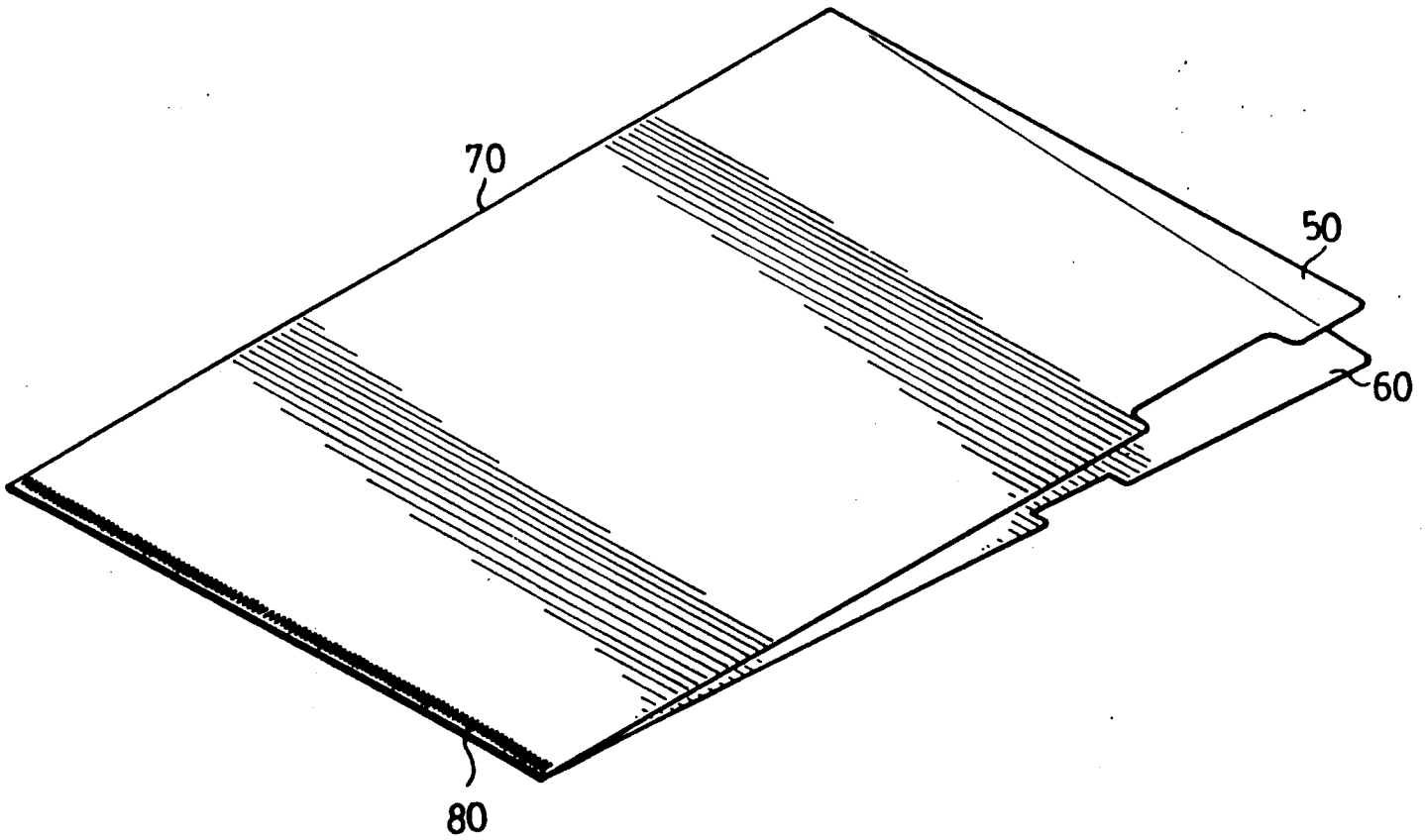
FIG. 5 PRIOR ART
FIG. 5 is a perspective view illustrating a conventional envelope.

Referring next to FIGS. 3 and 4, the heat weld along the bottom edge 30 is extended to the lower and right edge of the envelope opposite to the integrally formed side edge so that an extension 31 is formed and is perpendicular to the bottom edge 30. The extension 31 ends with a finger cut or a tear-proof nick 12 which is formed in the lower and right corner area of the face 10. A rounded portion 14 is preferably formed between the nick 12 and the extension 31 so that the stress will not be concentrated on the joining portion of the nick 12 and the extension 31 and so that the strength of the envelope is increased. When the envelope is opened, the nick 12 prevents the extension 31 from being directly torn down so that the durability of the envelope is increased and the working life of the envelope is lengthened.

Accordingly, the envelope in accordance with the present invention has an excellent durability and a longer working life, and papers and documents can be safely and stably retained within the envelope.

Although this invention has been described with a certain degree of particularly, it is to be understood that the present disclosure has been made by way of example only and that numerous changes in the detailed construction and the combination and arrangement of parts may be resorted to without departing from the spirit and scope of the invention as hereinafter claimed.

I claim:

1. An envelope comprising a face and a base having a side edge integrally formed together and having a bottom edge welded together, a slot being formed in upper edge portion of said face, a flap being integrally formed on an upper edge portion of said base, an ear being formed in said flap and being insertable through said slot of said face when said flap is folded and superposed upon said face so that said upper edge portion of said face and said upper edge portion of said base can be clamped together, a weld extension being formed on another side edge of said envelope opposite to said integrally formed side edge and connected to said welded bottom edge, said weld extension ending with a nick which is formed in a lower and side corner area of either said face or said base so that said weld extension is prevented from being torn when said envelope is opened, and so that papers disposed within said envelope can be safely and stably retained in place.

* * * * *